US006276781B1

(12) United States Patent
Hasegawa

(10) Patent No.: US 6,276,781 B1
(45) **Date of Patent: *Aug. 21, 2001**

(54) LIQUID JET RECORDING HEAD AND MANUFACTURING METHOD THEREFOR, AND LIQUID JET RECORDING HEAD DRIVE CIRCUIT AND DRIVE METHOD

(75) Inventor: Kazumasa Hasegawa, Nagano-ken (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/144,797

(22) Filed: Sep. 1, 1998

(30) Foreign Application Priority Data

Sep. 4, 1997 (JP) ..... 9-239299

(51) Int. Cl.[7] ..... B41J 2/14; B41J 2/16
(52) U.S. Cl. ..... 347/50; 347/68
(58) Field of Search ..... 347/68–72, 10–11, 347/57–59, 12, 40, 65, 44, 67

(56) References Cited

U.S. PATENT DOCUMENTS 4,364,069 * 12/1982 Kobayashi ..... 347/71
4,384,296 * 5/1983 Torpey ..... 347/75
4,597,794 * 7/1986 Ohta et al. ..... 347/100
4,881,318 * 11/1989 Komura et al. ..... 347/58
5,142,307 * 8/1992 Elrod et al. ..... 347/64
5,237,346 * 8/1993 Da Costa et al. ..... 346/155
5,281,980 * 1/1994 Kishida et al. ..... 347/13
5,453,767 * 9/1995 Chang et al. ..... 347/10
5,517,150 * 5/1996 Okumura ..... 327/427
5,548,314 * 9/1996 Okazawa et al. ..... 347/71
5,748,214 * 5/1998 Usui et al. ..... 347/70
5,757,392 * 5/1998 Zhang ..... 347/14
5,767,830 * 6/1998 Kawamura ..... 345/99
5,856,837 * 1/1999 Kitahara et al. ..... 347/70
5,872,372 * 2/1999 Lee et al. ..... 257/254

* cited by examiner

*Primary Examiner*—John Barlow
*Assistant Examiner*—Michael S. Brooke
(74) *Attorney, Agent, or Firm*—Hogan & Hartson, LLP

(57) ABSTRACT

The liquid jet recording head of this invention is configured such that the upper electrodes on a head substrate and the output terminals of a drive circuit using a thin film transistor are connected so as to face each other. P-channel thin film transistors are used in the analog switches in the drive circuit, and the piezoelectric device drive start timing is made to lag behind the timing with which the analog switches begin conducting.

15 Claims, 13 Drawing Sheets

LIQUID JET RECORDING HEAD AND MANUFACTURING METHOD THEREFOR, AND LIQUID JET RECORDING HEAD DRIVE CIRCUIT AND DRIVE METHOD

BACKGROUND OF THE INVENTION

1. Field of the Invention

This invention concerns a liquid jet recording head for use in a liquid jet recording apparatus, together with a manufacturing method therefor, and a liquid jet recording head drive circuit and drive method.

A liquid jet recording apparatus comprises one or more nozzles, a liquid jet recording head having a liquid chamber in contact with those nozzles, and a liquid supply system. By imparting energy to the liquid with which the liquid chamber is filled, that liquid is jetted from the nozzles, by which means text characters or graphical data are recorded. Means for imparting the energy to the liquid in general use include means for pressurizing the liquid inside the liquid chamber using a piezoelectric device, and means for heating the liquid inside the liquid chamber using a heater. The present invention concerns a liquid jet recording head, and manufacturing method therefor, that comprises means for pressurizing the liquid inside the liquid chamber using a piezoelectric device.

A liquid jet recording apparatus that uses a liquid jet recording head that uses a piezoelectric device comprises a drive circuit for generating a piezoelectric pulsing waveform for driving the piezoelectric device. The present invention concerns a liquid jet recording head drive circuit and drive method wherein a thin film transistor (hereinafter "TFT"), but more particularly a thin film transistor wherein polycrystalline silicon is used in the channels thereof (hereinafter "poly-Si TFT"), is employed.

2. Description of the Related Art

In terms of the prior art for the configuring elements pertaining to the present invention, there is Unexamined Patent Application H5-822140 [1993]. In the patent cited in this example of prior art, a liquid jet recording head and manufacturing method therefor are disclosed wherewith a liquid chamber, liquid flow path, and liquid storage chamber are formed in a monocrystalline silicon substrate, above the liquid chamber in which are formed a vibration plate and piezoelectric device that uses a piezoelectric film. With the liquid jet recording head in the prior art example cited above, however, there are problems, as described below. In the example cited, the configuration is one wherein the liquid chamber and liquid storage chamber, positioned horizontally, are connected via a liquid flow path. That being so, the liquid jet recording head in the prior art cited becomes large in its planar extent. Also, in the prior art cited, the configuration of the part that inputs drive signals to the piezoelectric device is not disclosed, but the configuration is ordinarily one wherein mounting tape having wiring patterns made thereon is connected to connecting terminals provided as electrode leads in the ends or edges of the liquid jet recording head, and a semiconductor integrated circuit wherein is formed a drive circuit made with MOS transistors is connected to the mounting tape. Accordingly, a conventional liquid jet recording head takes up a large space not only in its planar extent but also three-dimensionally. Furthermore, because the drive circuit used is based on semiconductor integrated circuitry, when the number of nozzles is increased, and particularly when a line liquid jet recording head is formed having 100 or more nozzles, the amount of space required is exceedingly large. In order to keep the price of such a drive circuit low, one may configure the drive circuit using a TFT, particularly a poly-Si TFT. However, the drive voltage cannot be raised very high due to concerns about TFT reliability, and the ON resistance of the TFT is larger than in a MOS transistor, wherefore the time required for the voltage waveform to rise in order to drive the piezoelectric device becomes long, leading to a deterioration in the liquid jetting characteristics of the liquid jet recording head.

SUMMARY OF THE INVENTION

The present invention was devised in view of the problems associated with the prior art, as noted above.

(1) One object of the present invention is to implement a line liquid jet recording head having 100 or more nozzles in a structure that is compact both in its planar extent and three-dimensionally.

(2) Another object of the present invention is to manufacture liquid jet recording heads having the compact structure noted above using an efficient method.

(3) Another object of the present invention is to provide a drive circuit and drive method for liquid jet heads wherein TFTs are used, wherewith the piezoelectric device drive voltage can be raised, and wherewith the rise time for the drive voltage waveform shortened.

In order to resolve the problems noted above, the liquid jet recording head according to the present invention is characterized by the following particulars.

(1) The liquid jet recording head comprises: nozzles; a liquid chamber for holding the liquid to be jetted; a vibration plate formed above the liquid chamber; a liquid supply hole passing through the vibration plate; and a piezoelectric device formed above the vibration plate and comprising: a lower electrode; a piezoelectric film; and an upper electrode; wherein: each are formed as a plurality lined up; the piezoelectric device is driven by a drive circuit that uses a thin film transistor provided above a dielectric substrate; the liquid supplied to the liquid chamber is made to jet out from the nozzles by bending the vibration plate and altering the volume capacity of the liquid chamber; the electrodes on the head substrate on which the nozzles, liquid chamber, vibration plate, liquid supply hole, and piezoelectric device are formed and the output terminals of the drive circuit using the thin film transistor on the dielectric substrate are connected facing each other; the space enclosed by the head substrate, the dielectric substrate end surfaces, and the mounting substrate is sealed; and a liquid storage chamber for storing the liquid supplied to the liquid chamber is formed.

(2) The alignment pitch for the piezoelectric devices and the alignment pitch for the drive circuit output terminals is made the same.

(3) A protective layer is provided at places where the upper electrodes come into contact with the drive circuit output terminals.

(4) The connecting terminals at the upper electrodes on the head substrate are positioned at both edges of the head substrate; the connecting terminals of the upper electrodes that are adjacent are positioned, respectively, on other edges of the head substrate; two circuits using thin film transistors are provided on the dielectric substrate; the connecting terminals on both sides of the head substrate and the output terminals of the circuit using thin film transistors on the two dielectric substrates are connected facing each other; a mounting substrate is provided at the surface where there is no thin film transistor in the two dielectric substrates; and a liquid storage chamber for storing the liquid supplied to the liquid chamber is formed in the space enclosed by the head substrate, the two dielectric substrate edge surfaces, and the mounting substrate.

(5) The upper electrodes on the head substrate are configured in a staggered pattern; the connecting terminals in the upper electrode pattern are positioned outside the adjacent upper electrode pattern edges; and the liquid supply hole passing through the vibration plate is positioned outside the upper electrode pattern edges and inside from the connecting terminals of adjacent upper electrodes.

(6) The nozzles, liquid chambers, vibration plates, and piezoelectric devices are arranged in two rows; the connecting terminals at the upper electrodes of the piezoelectric devices are positioned on both side edges of the head substrate; two circuits using thin film transistors are provided on the dielectric substrates; the connecting terminals on both side edges of the head substrate and the output terminals of the circuits using thin film transistors on the two dielectric substrates are connected facing each other; mounting substrates are provided on the surfaces where there are no thin film transistors in the two dielectric substrates; and a liquid storage chamber for storing the liquid that is supplied to the liquid chambers is formed in the space enclosed by the head substrate, the two dielectric substrate edge surfaces, and the mounting substrates. The liquid jet recording head manufacturing method of the present invention, moreover, is characterized by the following particulars.

(7) The manufacturing method comprises the steps of: connecting, so that they face each other, the upper electrodes in the head substrate that comprises nozzles, liquid chambers, vibration plates, liquid supply holes, and piezoelectric devices comprising lower electrodes, piezoelectric films, and upper electrodes, and output terminals of drive circuits using thin film transistors and provided on dielectric substrates; forming protective layers at the places where the upper electrodes come into contact with the drive circuit output electrodes; and providing mounting substrates at surfaces of dielectric substrates having no thin film transistors.

(8) The manufacturing method comprises a step for sealing the space enclosed by the head substrate, the dielectric substrate edge surfaces, and the mounting substrates, after the step of providing the mounting substrates at the surfaces of the dielectric substrates having no thin film transistors. The liquid jet recording head drive circuit of the present invention, moreover, is characterized by the following particulars.

(9) It is a drive circuit for driving the piezoelectric devices in a liquid jet recording head that comprises: nozzles, a liquid chamber for holding the liquid to be jetted, and a piezoelectric device and vibration plate formed on the liquid chamber, wherein each are formed as a plurality lined up, the piezoelectric device is driven, the vibration plate is bent, and the volume capacity of the liquid chamber is altered, thereby causing the liquid supplied to the liquid chamber to be jetted out from the nozzles; wherein: the drive circuit is configured by a sweep circuit based on a thin film transistor, and an analog switch; the analog switch is configured by a P-channel type thin film transistor; the output terminal of the analog switch is connected to the electrode on one side of the piezoelectric device; and the piezoelectric device drive signals are input from the other electrode of the piezoelectric device.

(10) The relationship $$C/(L \cdot W) \geqq 3.3 \times 10^{-2} (F/m^2)$$

is satisfied, where L is the channel length of the P-channel thin film transistor of the analog switch, W is the channel width, and C is the capacitance of the piezoelectric device. The liquid jet recording head drive method of the present invention, moreover, is characterized by the following particular.

(11) The timing of starting the piezoelectric device drive in the piezoelectric device drive signals is made later than the timing of starting the conductivity of the analog switch.

DESCRIPTION OF THE PREFERRED EMBODIMENTS

Embodiments of the present invention are now described, making reference to the drawings.

(Embodiment 1)

Figure 1:
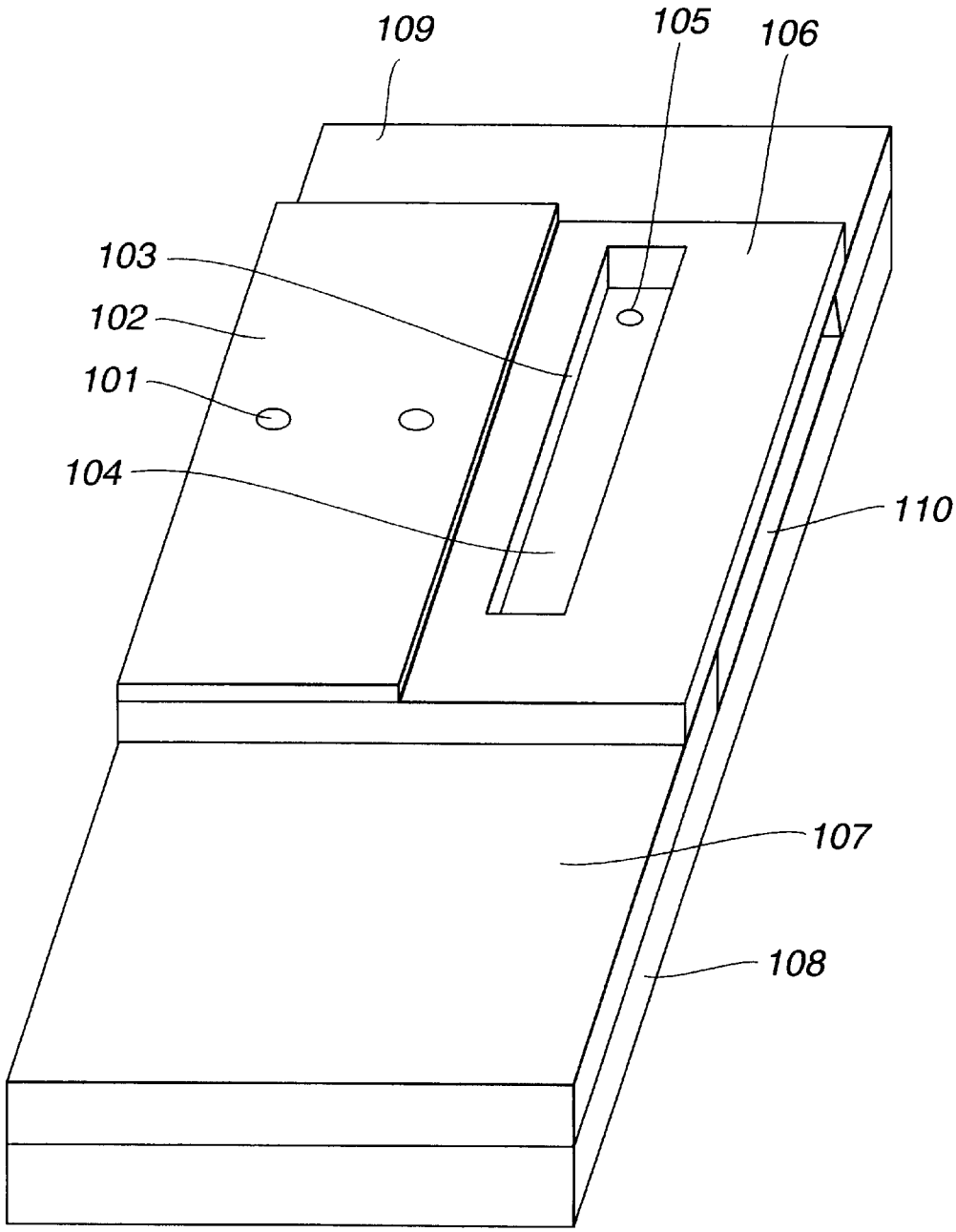
FIG. 1 is a diagonal view of a liquid jet recording head in an embodiment of the present invention.
Figure 2A:
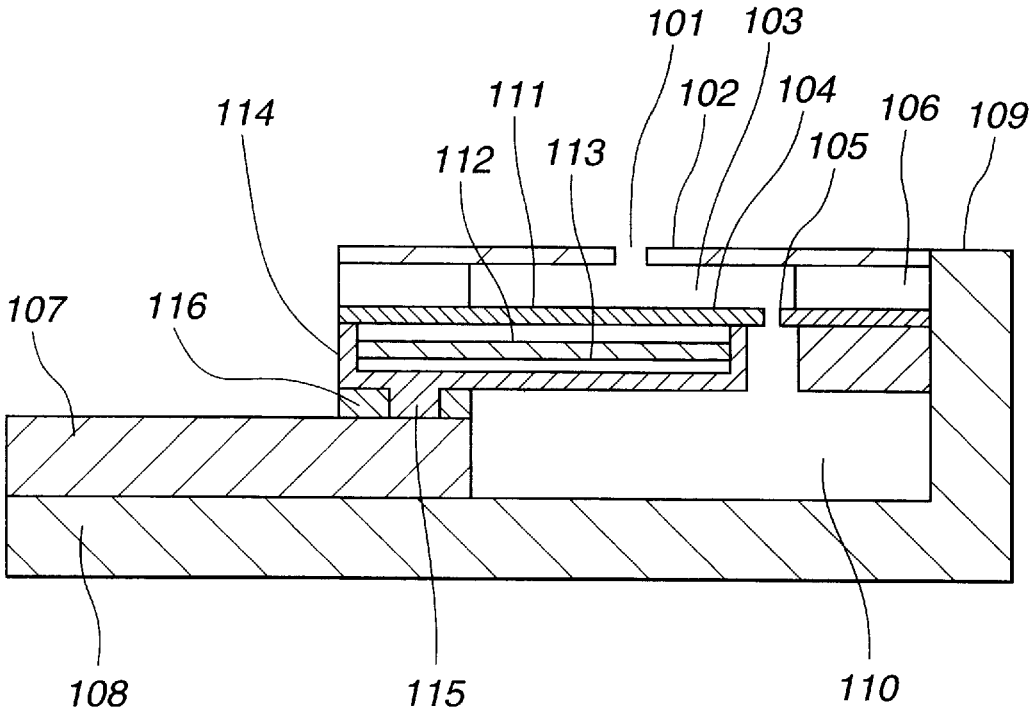
FIG. 2 is a cross-sectional view of a liquid jet recording head in an embodiment of the present invention.
Figure 2B:
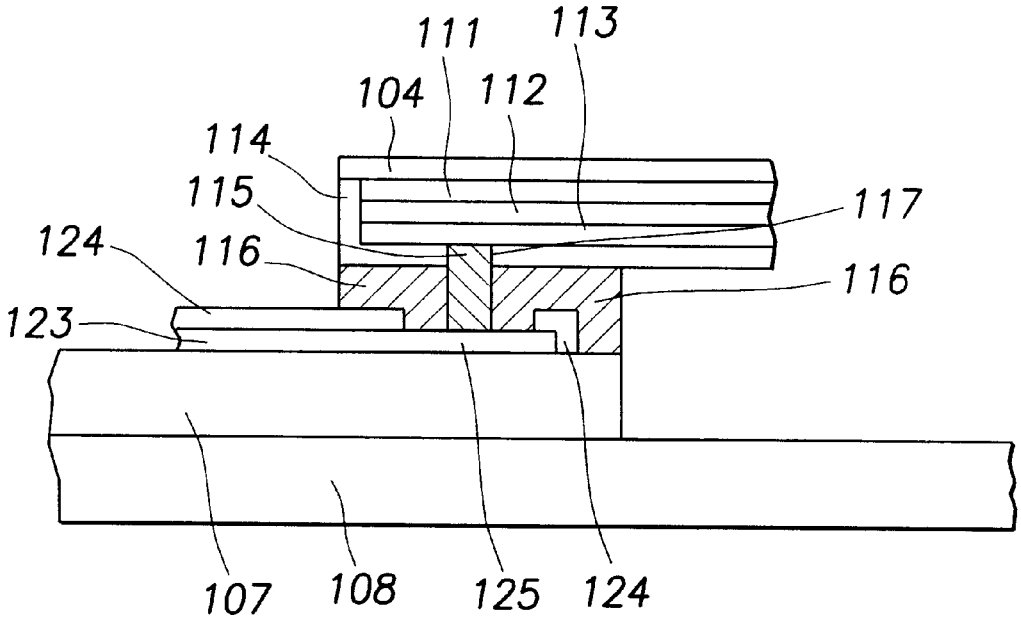
Figure 3:
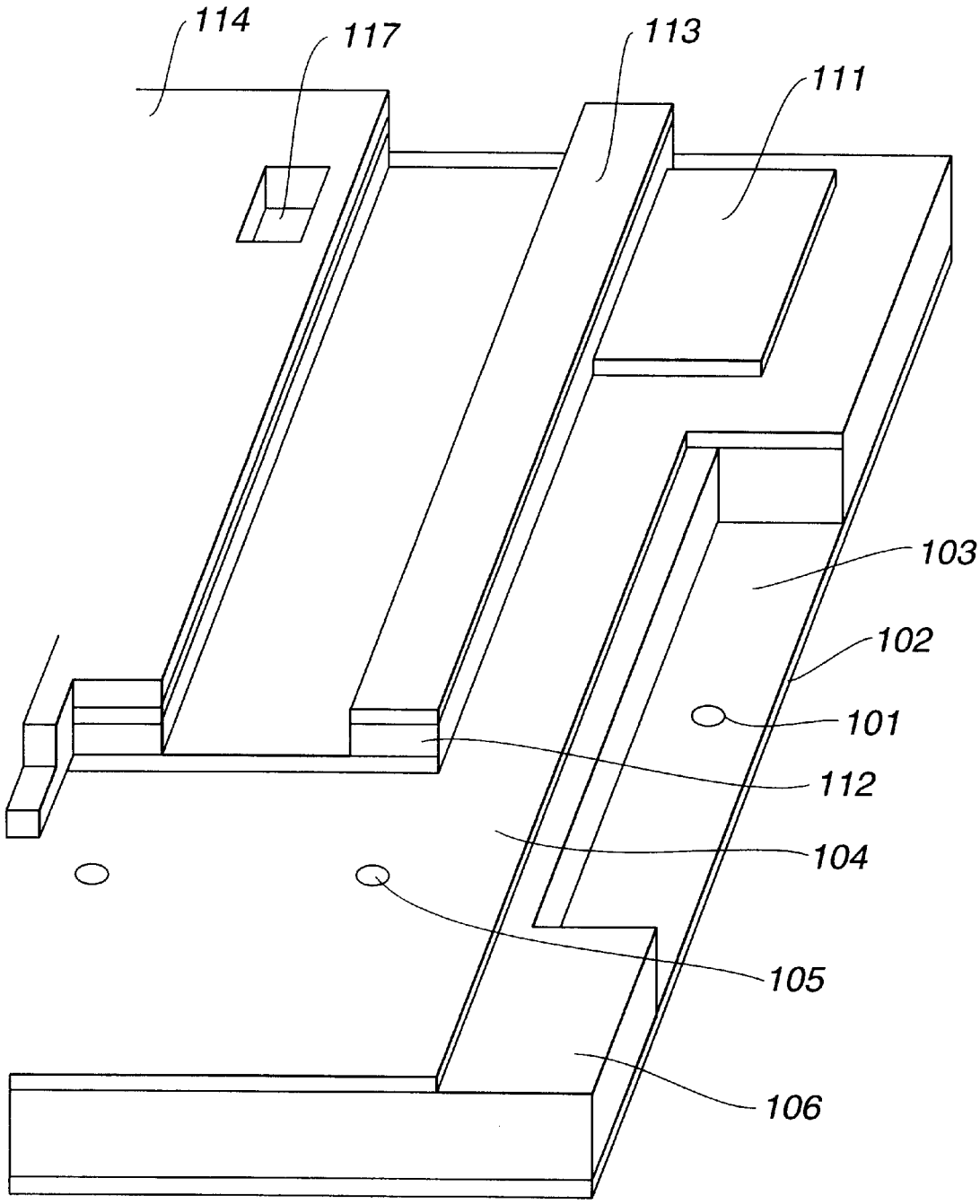
FIG. 3 is a diagonal view of a head substrate wherein are formed nozzles, a liquid chamber, a vibration plate, a liquid supply hole, and a piezoelectric device, in a liquid jet recording head in an embodiment of the present invention.
Figure 4:
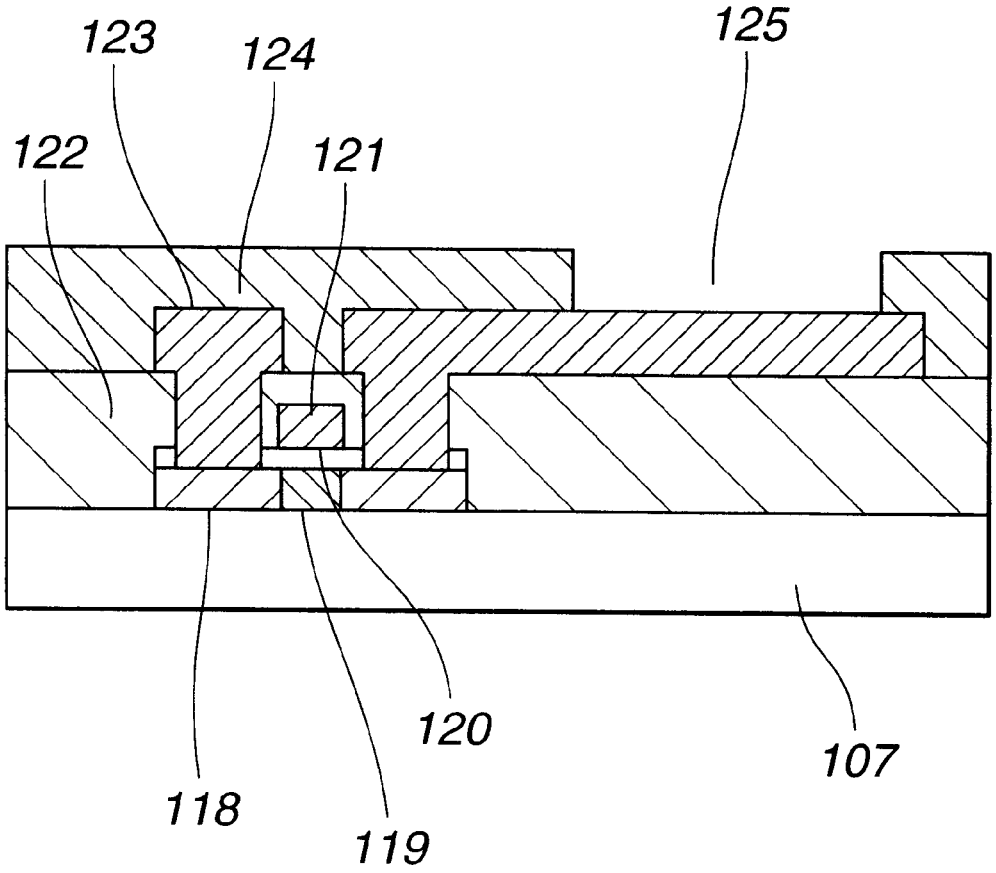
FIG. 4 is a cross-sectional view of a TFT on a dielectric substrate configuring a drive circuit, in a liquid jet recording head in an embodiment of the present invention.

FIG. 1 is a diagonal view of a liquid jet recording head in an embodiment of the present invention; FIG. 2 is a cross-sectional view thereof; FIG. 3 is a diagonal view of a head substrate wherein are formed nozzles, a liquid chamber, a vibration plate, a liquid supply hole, and a piezoelectric device, in a liquid jet recording head in an embodiment of the present invention; and FIG. 4 is a cross-sectional view of a TFT on a dielectric substrate configuring a drive circuit, in a liquid jet recording head in an embodiment of the present invention.

The configuration of the liquid jet recording head in this embodiment is now described, with reference to FIG. 1. Item 101 is a nozzle, 102 is a nozzle plate, 103 is a liquid chamber, 104 is a vibration plate drawn below the liquid chamber, 105 is a liquid supply hole that passes through the vibration plate, and 106 is a partition for the liquid chamber. A head substrate is configured by these configurational elements, namely items 101 to 106. The piezoelectric device is not shown in the drawing, but is positioned further below the vibration plate 104. Item 107 is a dielectric substrate on which is formed a drive circuit that uses a TFT. The TFT is not shown in the drawing, but it is positioned above the dielectric substrate 107. Item 108 is a mounting substrate, provided on the side of the dielectric substrate 107 on which there is no TFT. Item 109 is a sealing structure for sealing in the space enclosed by the head substrate, the edge surfaces of the dielectric substrate 107, and the mounting substrate 108. The space that is sealed thereby constitutes a liquid storage chamber 110.

The detailed configuration of the liquid jet recording head in this embodiment, the manufacturing method therefor, and the liquid jetting action therein are now described with reference to FIG. 2. The head substrate comprises the nozzle 101, nozzle plate 102, liquid chamber 103, vibration plate 104, liquid supply hole 105, liquid chamber partition 106, lower electrode 111, piezoelectric film 112, upper electrode 113, and protective film 114. The piezoelectric device is made up of the lower electrode 111, piezoelectric film 112, and upper electrode 113. When a voltage is applied across the upper and lower electrodes of the piezoelectric device, the piezoelectric film 112 is deformed and, as a result, the piezoelectric device deforms alternately between the vibration plate 104 and protective film 114. An opening is formed in the protective film 114. The upper electrode of the head substrate and the output terminals (not shown) of the drive circuit on the dielectric substrate 107 whereon is formed the drive circuit using the TFT are connected, via a connecting electrode 115 formed in the opening, so that they face each other. At the place where this electrode is connected, a protective layer 116 is formed.

The mounting substrate 108 is provided on the side of the dielectric substrate 107 on which there is no TFT, the space enclosed thereby is sealed in by the sealing structure 109, and the liquid storage chamber 110 is thus formed. In this liquid jet recording head manufacturing method, a bump is formed, by metal, for example, as the connecting electrode 115, in the opening in the protective film 114 of the head substrate made up of the nozzle 101, nozzle plate 102, liquid chamber 103, vibration plate 104, liquid supply hole 105, liquid chamber partition 106, lower electrode 111, piezoelectric film 112, upper electrode 113, and protective film 114, and, solder, for example, is placed on the output terminals of the drive circuit on the dielectric substrate 107 on which the drive circuit using a TFT is formed, which is not shown in the drawing; these are positioned so that they face each other, heat is applied to effect bonding, and they are connected. After this connection process, the protective layer 116 is formed at the connection, using a dielectric epoxy material, for example, and the connection is thus electrically and mechanically protected. Also, on the side of the dielectric substrate 107 on which there is no TFT, a mounting substrate 108, formed of glass, for example, is provided and bonded, thereby completing the liquid jet recording head of this embodiment. The bump may also be formed on the output terminal or terminals of the drive circuit on the dielectric substrate 107, or, alternatively, the connection between this and the head substrate electrodes may be effected using a material such as an anisotropic conducting film. It is also permissible to use a material such as wettable glass in the protective layer 106 at this connection. The action of this liquid jet recording head becomes that described below. The liquid chamber 103 and liquid storage chamber 110 are filled with liquid beforehand. A positive power supply signal is applied to the upper electrode of the piezoelectric device from the TFT-based drive circuit on the dielectric substrate 107. When this is done, a piezoelectric device drive signal is input on the lower electrode 111 of the piezoelectric device, and a voltage is applied across the upper and lower electrodes of the piezoelectric device. At this time, the piezoelectric film 112 is deformed, as a result of which the piezoelectric device deforms on the upper side in the drawing, alternating between the vibration plate 104 and the protective film 114. Accordingly, the liquid with which the liquid chamber 103 is filled is jetted out through the nozzle 101. Subsequently, when the voltage applied across the upper and lower electrodes of the piezoelectric device is restored to its original state, the piezoelectric device, vibration plate 104, and protective film 114 also return to their original states, the liquid with which the liquid storage chamber 110 is filled is supplied to the liquid chamber 103 via the liquid supply hole 105 by capillary action, and thus fills the liquid chamber 103.

Thereupon, liquid is also supplied from the outside, simultaneously, so as to fill the liquid storage chamber 110. By repeating this action over and over, liquid is jetted continuously from the liquid jet recording head.

FIG. 3 describes the configuration of the head substrate in the liquid jet recording head in this embodiment. In this figure, the same reference characters are used as in FIGS. 1 and 2 for the same items, respectively. Item 117 is an opening in the protective film 114, becoming a connecting terminal from the upper electrode 113 of the piezoelectric device and, hence, also from this head substrate. Although not shown in the drawing, the opening in the protective film 114 is actually also formed above the lower electrode 111 of the piezoelectric device, and piezoelectric device drive signals are thus supplied to the lower electrode 111.

FIG. 4 describes, in cross-section, the configuration of the drive circuit wherein the TFT is used in the liquid jet recording head in this embodiment. The TFT source-drain unit 118 and channel unit 119 are formed on the dielectric substrate 107 with, for example, a poly-Si thin film. An impurity such as phosphorous or boron is diffused in the source-drain unit. A gate dielectric film 120 is formed on the channel unit 119 with, for example, a film of silicon dioxide, and a gate electrode 121 is formed also, of tantalum, for example. Above that, an interlayer dielectric film 122 is formed, of silicon dioxide, for example, and a metal wiring layer 123 is formed, of aluminum, for example. A protective layer 124, finally, is formed, of silicon dioxide, for example, and an opening is formed in the protective layer 124, thereby forming an output terminal 125 for the drive circuit, whereupon the TFT-based drive circuit is complete. By making the alignment pitch of these drive circuit output terminals 125 of this drive circuit the same as the alignment pitch of the piezoelectric devices, it becomes possible to configure the liquid jet recording head of this embodiment.

In the embodiment described above, by connecting the upper electrode 113 on the head substrate and the output terminal 125 of the drive circuit using the TFT on the dielectric substrate 107 so that they face each other, providing a mounting substrate 108 on the side of the dielectric substrate 107 on which there is no TFT, sealing in the space enclosed by the head substrate, the edge surfaces of the dielectric substrate 107, and the loading substrate 108, and forming the liquid storage chamber 110, and also by making the alignment pitch of the piezoelectric devices on the head substrate and the alignment pitch of the output terminals 125 of the drive circuit the same, it becomes possible to effect a structure that is compact in its planar extent and three-dimensionally, even in a line liquid jet recording head having 100 or more nozzles. Moreover, by providing the protective layer 116 where the upper electrode 113 and the output terminal 125 of the drive circuit are connected, it is possible to provide mechanical protection and electrical insulation for the connection, thus making it possible also to jet electrically conductive liquids. Furthermore, by first connecting the upper electrode 113 on the head substrate and the output terminal 125 of the drive circuit using the TFT on the dielectric substrate 107 so that they face each other, then forming the protective layer 116 for this connection, and finally providing the mounting substrate at the surface of the dielectric substrate 107 where there is no TFT, the formation of the protective layer 116 is rendered easy, inspecting for and repairing coating irregularities on the protective layer 116 is also made easy, and the liquid jet recording head manufacturing method is made efficient.

(Embodiment 2)

Figure 5:
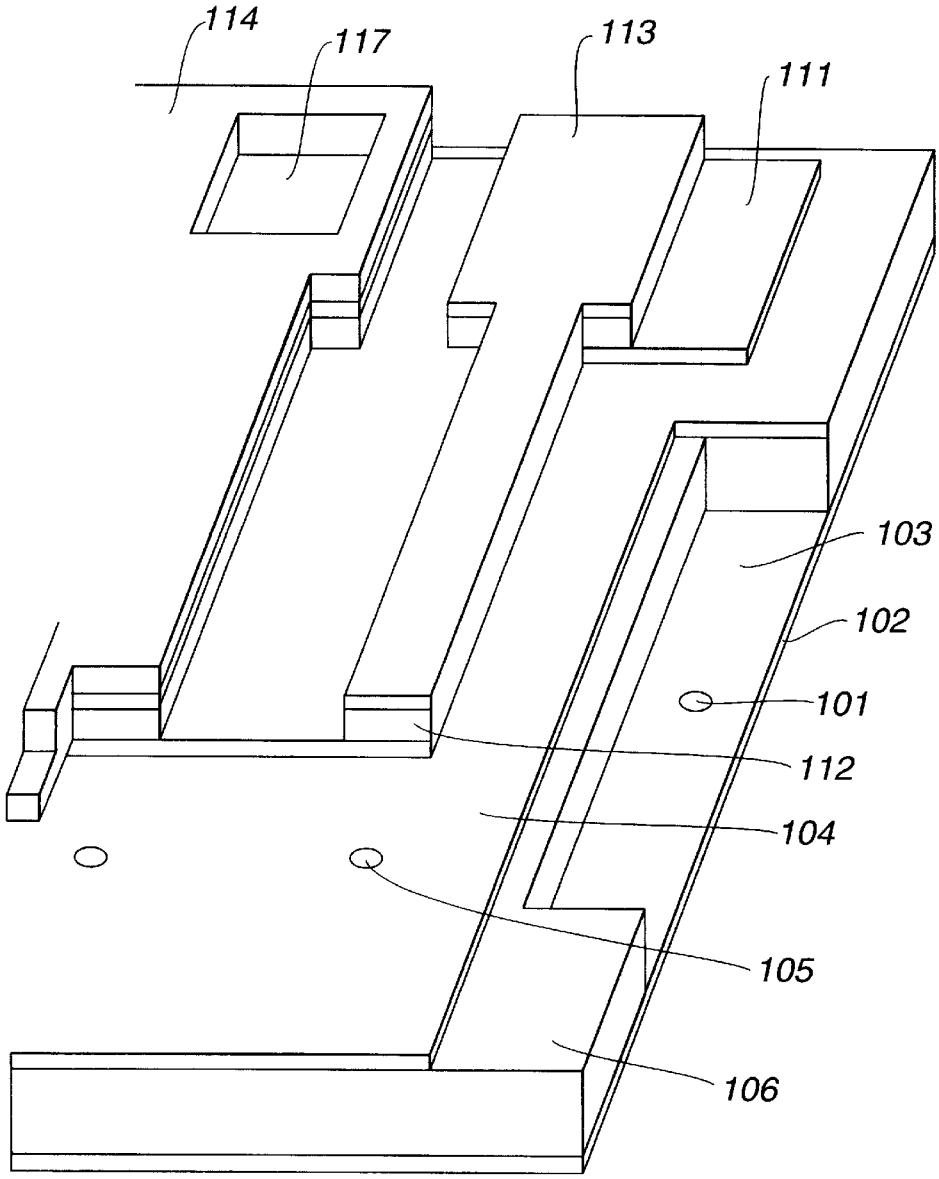
FIG. 5 is a diagonal view of a head substrate in a liquid jet recording head in an embodiment of the present invention, wherein the alignment pitch of the connecting terminals of the upper electrodes are made the same as the alignment pitch of the piezoelectric devices, and the length of the connecting terminals in the pitch dimension is made longer than the length of the upper electrodes on the liquid chamber in the pitch dimension.

FIG. 5 is a diagonal view of a head substrate in a liquid jet recording head in an embodiment of the present invention wherein the alignment pitch of the upper electrode connecting terminals is made the same as the alignment pitch of the piezoelectric devices, and the length of the connecting terminals in the pitch direction is made longer than the length of the upper electrode above the liquid chamber in the pitch direction. In this figure, the same reference characters as in FIG. 3 are used for the same items, respectively.

The length in the alignment pitch dimension of the piezoelectric film 112, upper electrode 113, and connecting terminal 117 in the connecting terminal unit are longer here than the length of the upper electrode 113 on the liquid chamber 103. By implementing this configuration, the area of the connecting terminal 117 can be made large, and, in the connecting terminal unit wherein the output terminal 125 of the drive circuit using the TFT is connected in opposition, as indicated in the first embodiment, mechanical strength can be increased even further, electrical resistance can be reduced, and manufacturing flaws can be reduced.

The configuration in this embodiment is particularly effective when the nozzle density in the liquid jet recording head is high. With a nozzle density of 360 dpi (approximately 70.5 $\mu$m pitch), for example, the length in the alignment pitch dimension of the upper electrodes 113 on the liquid chamber 103 is about 30 $\mu$m. With this electrode width, it is very difficult to connect the output terminal of the TFT-based drive circuit in opposition. However, by adopting the configuration of this embodiment, it is possible to make the length in the alignment pitch dimension of the head substrate connecting terminal 117 about 50 $\mu$m, and thus to connect the output terminal of the TFT-based drive circuit in opposition.

(Embodiment 3)

Figure 6:
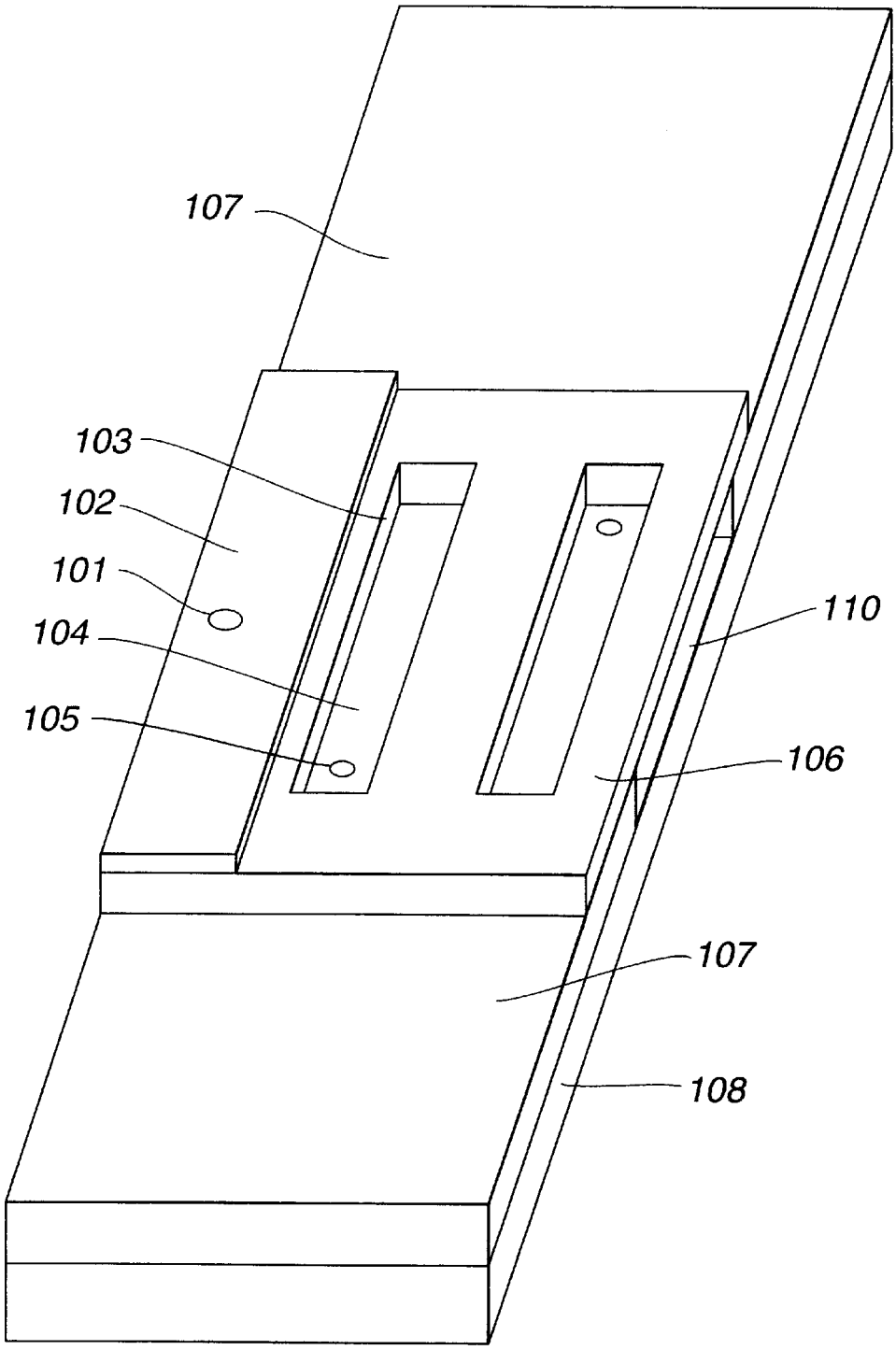
FIG. 6 is a diagonal view of a liquid jet recording head that is provided with drive circuits using TFTs on both edges of the head substrate in an embodiment of the present invention.
Figure 7:
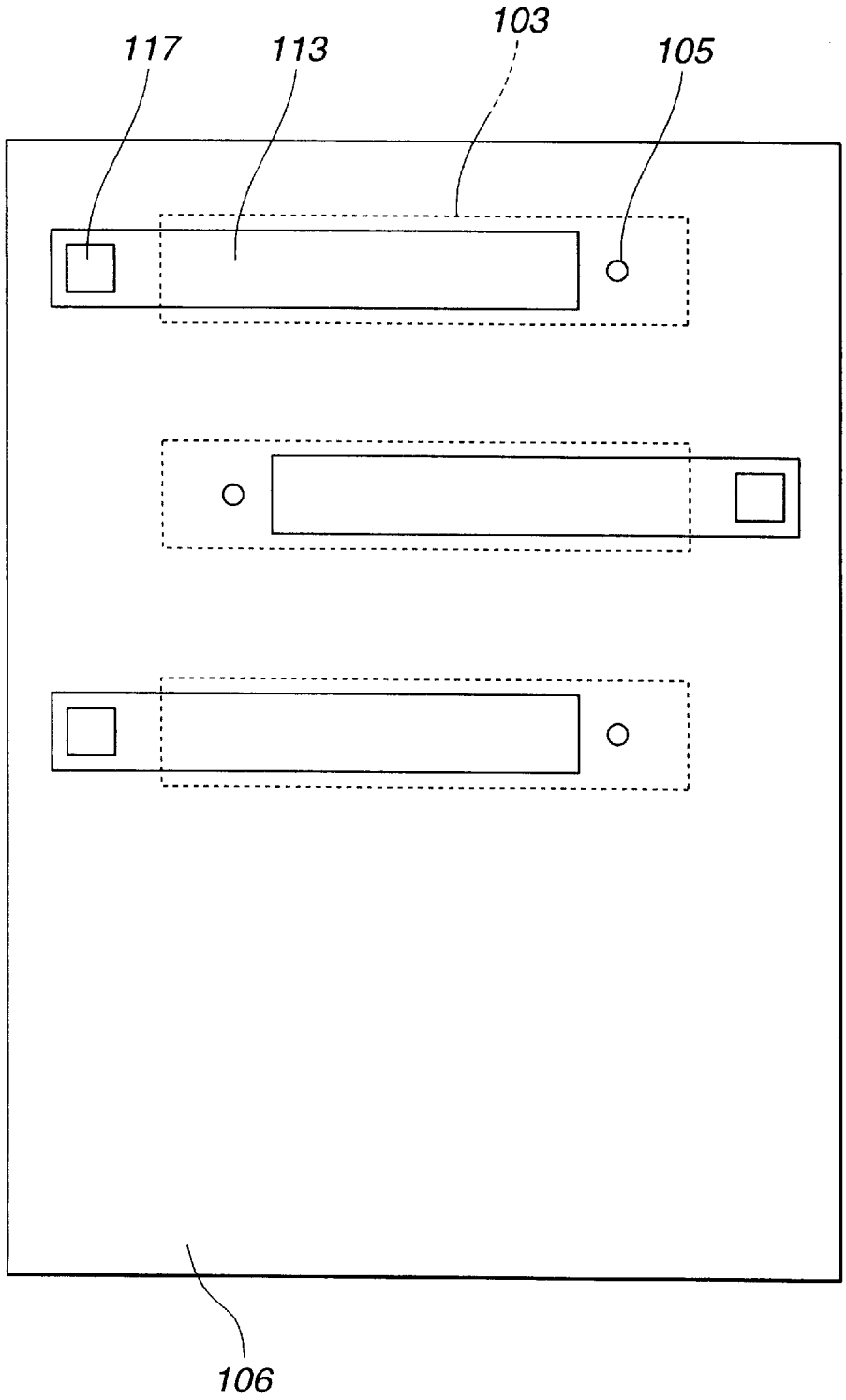
FIG. 7 is a plan of a head substrate comprising nozzles, liquid chambers, vibration plates, liquid supply holes, and piezoelectric devices, in a liquid jet recording head wherein are provided drive circuits using TFTs on both edges of the head substrate in an embodiment of the present invention.

FIG. 6 is a diagonal view of a liquid jet recording head wherein drive circuits using TFTs are provided at both edges of the head substrate in an embodiment of the present invention, while FIG. 7 is a plan of a head substrate wherein are formed one or more nozzles, liquid chambers, vibration plates, liquid supply holes, and piezoelectric devices, in the same liquid jet recording head. In FIGS. 6 and 7, the same reference characters used in FIGS. 1 and 3 are used for the same items, respectively.

The configuration of the liquid jet recording head in this embodiment is described with reference to FIG. 6. In a head substrate comprising a nozzle 101, nozzle plate 102, liquid chambers 103, vibration plates 104, liquid supply holes 105, and liquid chamber partition 106, and also comprising piezoelectric devices (not shown) below the vibration plates 104 in the middle of the figure, connecting terminals (not shown) at the upper electrodes of the piezoelectric devices are positioned at both edges of the head substrate (described below in greater detail), dielectric substrates 107 provided with a TFT-based drive circuit are positioned on both sides of the head substrate, and the connecting terminals at the upper electrodes of the piezoelectric devices provided on both sides of the head substrate and the output terminals (not shown) of the TFT-based drive circuits on the dielectric substrate 107 are connected facing each other. One mounting substrate 108 is provided on the sides of two dielectric substrates 107 not having a TFT, whereupon the space enclosed by the head substrate, the edge surfaces of the two dielectric substrates 107, and the mounting substrate 108 becomes a liquid storage chamber 110.

The planar configuration of the head substrate in the liquid jet recording head in this embodiment is now described with reference to FIG. 7. The liquid chambers 103 are aligned in one row, while the upper electrodes 113 of the piezoelectric devices are aligned in a staggered pattern so as to extend across both the liquid chambers 103 and the partition 106. The connecting terminals 117 of the upper electrodes 113 are positioned outside the edges of the pattern of adjacent upper electrodes and the edges of the liquid chamber pattern. Also, the liquid supply holes 105 that pass through the vibration plates (not shown) are positioned so as to be outside the edges of the upper electrode pattern, inside the edges of the liquid chamber pattern, and inside of the connecting terminals of adjacent upper electrodes.

With the liquid jet recording head in this embodiment, as described in the foregoing, the alignment pitch of the connecting terminals in the head substrate can be made double the alignment pitch of the liquid chambers 103, thus making it possible to effect connections between the head substrate and the TFT-based drive circuits even in liquid jet recording heads wherein nozzles are formed in higher density.

(Embodiment 4)

Figure 8:
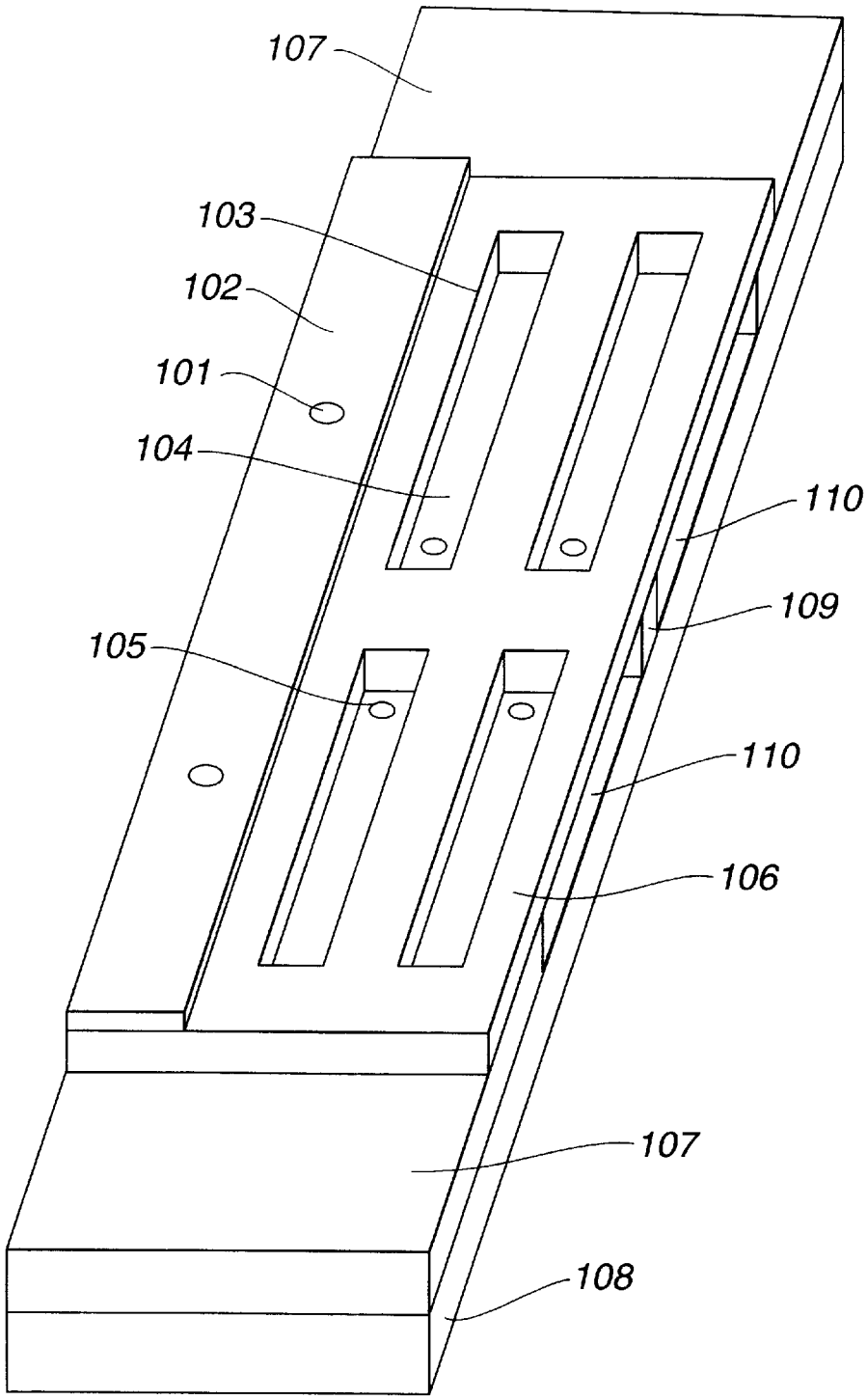
FIG. 8 is a diagonal view of a liquid jet recording head wherein the nozzles, liquid chambers, vibration plates, and piezoelectric devices are arranged in two rows, in an embodiment of the present invention.
Figure 9:
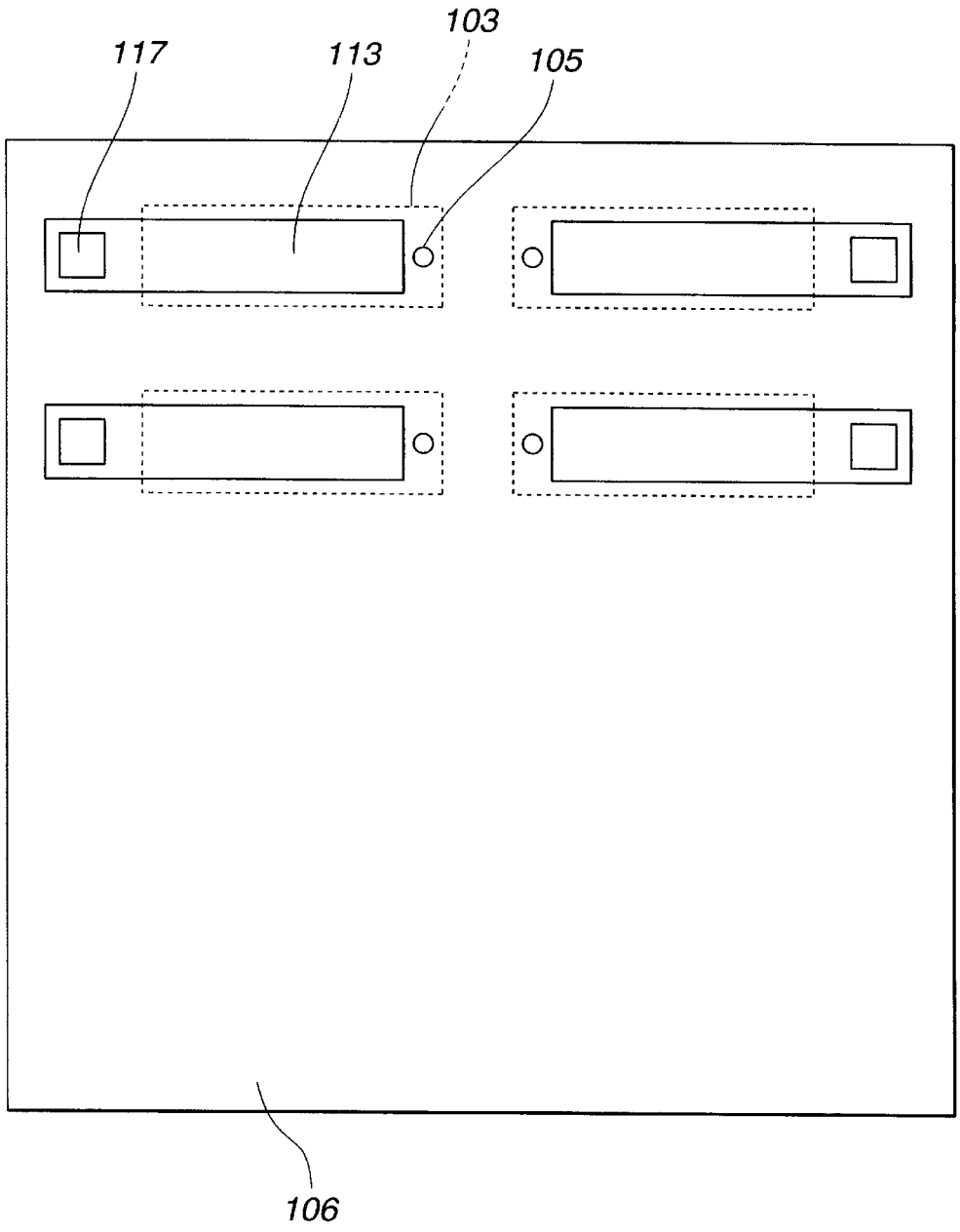
FIG. 9 is a plan of a head substrate comprising nozzles, liquid chambers, vibration plates, liquid supply holes, and piezoelectric devices, in a liquid jet recording head in an embodiment of the present invention.

FIG. 8 is a diagonal view of a liquid jet recording head wherein nozzles, liquid chambers, vibration plates, and piezoelectric devices are aligned in two rows, in an embodiment of the present invention, while FIG. 9 is a plan of a head substrate on which are formed nozzles, liquid chambers, vibration plates, liquid supply holes, and piezoelectric devices, in the same liquid jet recording head. In FIGS. 8 and 9, the same reference characters are used as in FIGS. 1 and 3 for the same items, respectively.

The configuration of the liquid jet recording head in this embodiment is now described with reference to FIG. 8. In a head substrate comprising nozzles 101, a nozzle plate 102, liquid chambers 103, vibration plates 104, liquid supply holes 105, and a liquid chamber partition 106, and, in addition, piezoelectric devices (not shown) formed below the vibration plates 104 in the middle of the figure, the nozzles 101, liquid chambers 103, vibration plates 104, liquid supply holes 105, and piezoelectric devices (not shown), are aligned in two rows. The connecting terminals (not shown) at the upper electrodes of the piezoelectric devices are positioned at both edges of the head substrate (described below in greater detail), dielectric substrates 107 provided with TFT-based drive circuits are positioned on both sides of the head substrate, and the connecting terminals at the upper electrodes of the piezoelectric devices provided at both edges of the head substrate and the output terminals (not shown) of the TFT-based drive circuits on the dielectric substrates 107 are connected facing each other. One mounting substrate 108 is provided on the side of two dielectric substrates 107 on which there is no TFT, and spaces enclosed by the head substrate, the edge surfaces of the two dielectric substrates 107, and the mounting substrate 108 are partitioned by a sealing structure 109 in each row, forming liquid storage chambers 110.

The planar configuration of the head substrate in the liquid jet recording head of this embodiment is now described with reference to FIG. 9. The liquid chambers 103 are aligned in two rows, and the upper electrodes 113 of the piezoelectric devices are aligned in two rows so as to reach across the liquid chambers 103 and the partition 106. The connecting terminals 117 of the upper electrodes 113 are positioned at both edges of the head substrate (having the same outer shape as the partition 106), while the liquid supply holes 105 that pass through the vibration plates (not shown) are positioned outside the edges of the upper electrode pattern and inside the edges of the liquid chamber pattern.

With the liquid jet recording head in this embodiment, as described in the foregoing, simultaneous double-row liquid jet recording is possible, thereby facilitating higher liquid jet recording speeds and color implementation. In addition, by aligning two rows of nozzles, etc., in a staggered pattern, it is possible to achieve high-density liquid jet recording.

(Embodiment 5)

Figure 10:
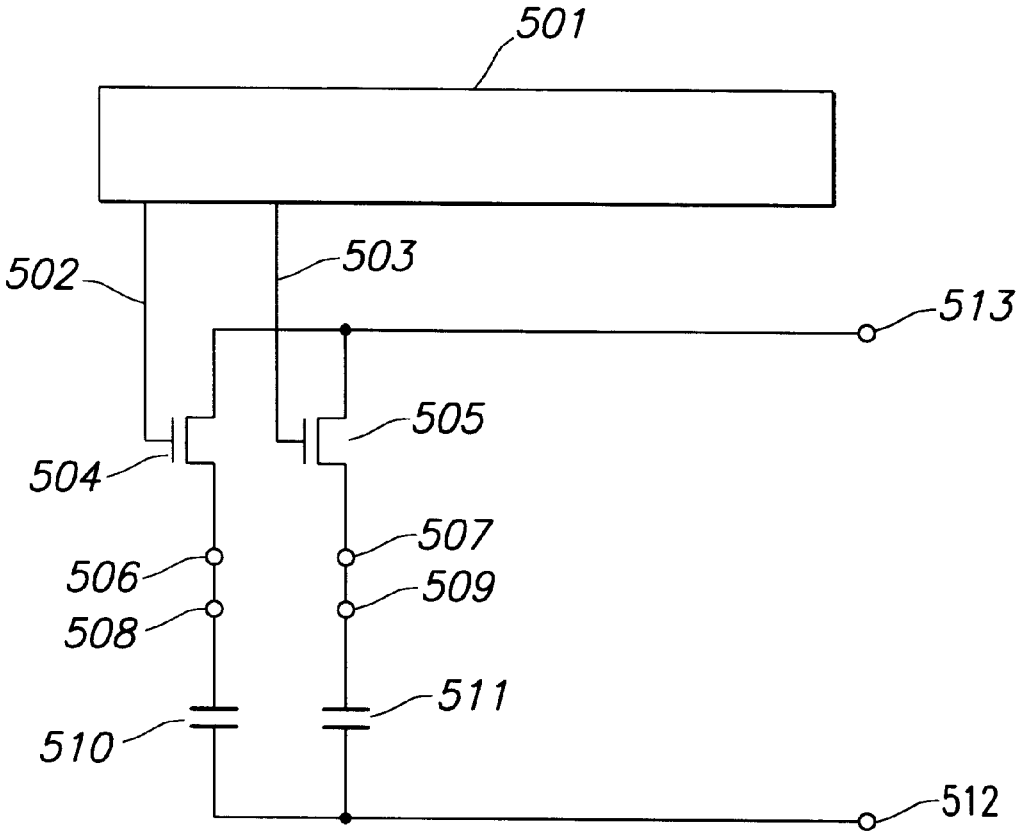
FIG. 10 is a schematic of a drive circuit for a liquid jet recording head in an embodiment of the present invention.

FIG. 10 is a schematic of a drive circuit for a liquid jet recording head in an embodiment of the present invention. Item 501 is a scanning circuit, the configuration of which is based on a TFT. This scanning circuit may be configured with shift registers, but it is also permissible to provide buffer inverters, etc., in the output stage thereof. Items 502 and 503 are output signal lines for the scanning circuit 501, each of which is connected to the gates of P-channel TFT-based analog switches 504 and 505. Items 506 and 507 are output terminals for the analog switches 504 and 505, respectively, and correspond to the output terminals of the TFT-based drive circuits formed on the dielectric substrates in the embodiments described above. The analog switch output terminals 506 and 507 are connected, respectively, to the connecting terminals 508 and 509 of the upper electrodes 510 and 511 of the piezoelectric devices. The other electrodes (lower electrodes) of the piezoelectric devices 510 and 511 are connected to the piezoelectric device drive signal input terminal 512. And the other terminals of the analog switches 504 and 505 are connected to the positive power supply input terminal 513.

Figure 11:
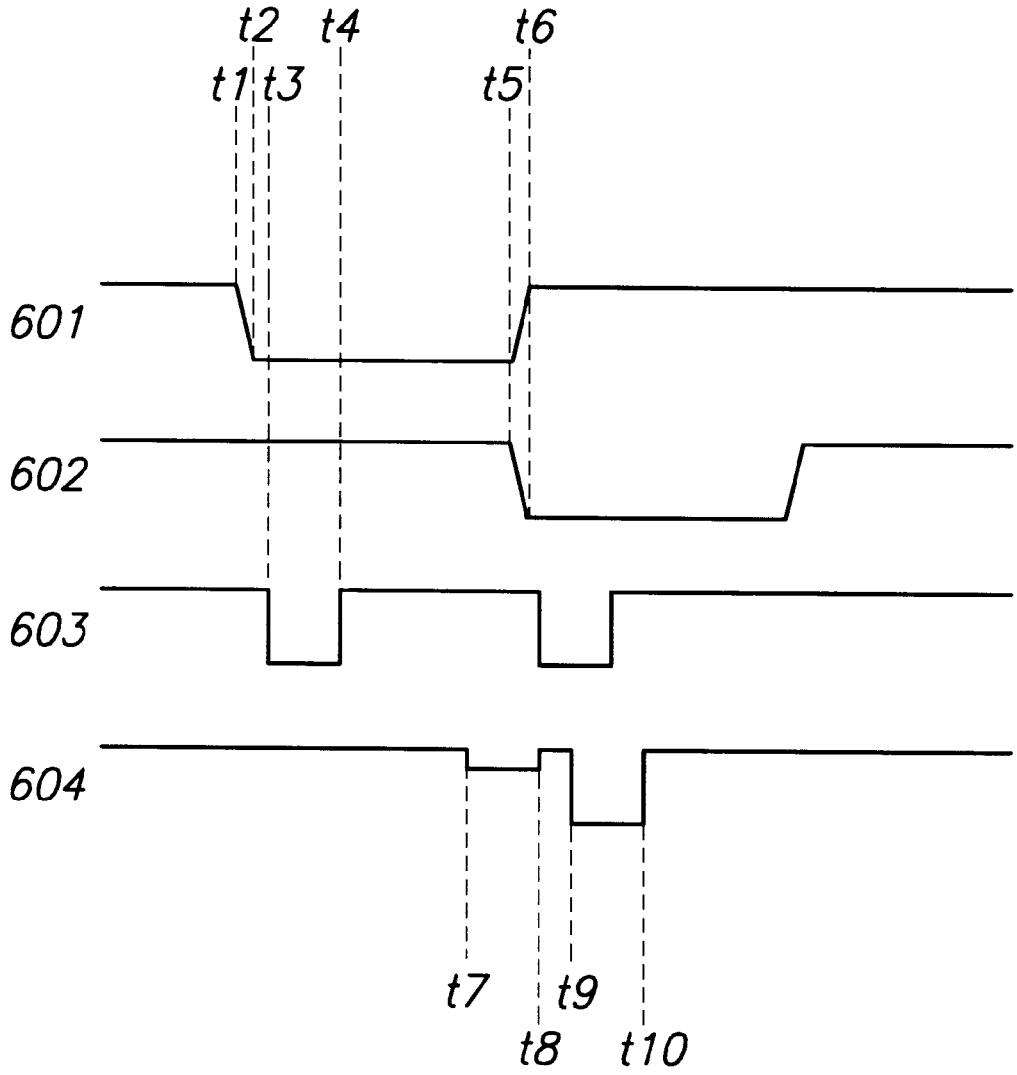
FIG. 11 is a timing diagram for liquid jet recording head drive signals, in an embodiment of the present invention.

FIG. 11 is a timing diagram for drive signals for a liquid jet recording head in an embodiment of the present invention. Items 601 and 602 are waveforms of voltages applied, respectively, to the output signal lines 502 and 503 of the scanning circuit 501. Item 603 is one example of a voltage waveform in a piezoelectric device drive signal applied to the piezoelectric device drive circuit input terminal 512. Item 604 is another example of a voltage waveform in a piezoelectric device drive signal applied to the piezoelectric device drive signal input terminal 512. The drive circuit action in the liquid jet recording head in this embodiment is now described with reference to FIG. 11.

At time t1, the voltage waveform 601 on the output signal line 502 of the scanning circuit 501 begins to fall from a HIGH state, reaching a LOW state at time t2. At this time, the P-channel TFT-based analog switches are completely closed and conducting, and a positive potential (same potential as HIGH potential noted above) is applied to the upper electrode of the piezoelectric device 510. Then, at time t3, the potential of the piezoelectric device drive signal 603 becomes negative, a negative potential is applied to the lower electrode of the piezoelectric device 510, a voltage is applied across the upper and lower electrodes of the piezoelectric device 510, and the piezoelectric device 510 is driven. At this time, in the piezoelectric device 511, although the lower electrode is at a negative potential, the gate potential of the analog switch 505 is HIGH, so that this analog switch is in a non-conducting state, wherefore the potential on the upper electrode of the piezoelectric device 511 also becomes negative, and the device is not driven. At time t4 the potential on the lower electrode of the piezoelectric device 510 returns to positive, whereupon the driving of this piezoelectric device is terminated.

Subsequently, at time t5, the gate potential of the analog switch 504 begins to rise, and, simultaneously, the gate potential of the analog switch 504 begins to fall. At time t6 the gate potential of the analog switch 504 becomes LOW, whereupon this analog switch is in a non-conducting state. Simultaneously, the gate potential of the analog switch 505 becomes LOW, whereupon this analog switch is in a conducting state. The piezoelectric device 511 is also driven by an identical action.

With the method of driving a liquid jet recording head described in the forgoing, the timing of starting the piezoelectric device drive is retarded behind the timing with which the analog switches begin to conduct, that is, after the analog switches have completely closed. By adopting such a drive method as this, as compared to when the piezoelectric device drive is started with the timing with which the analog switches begin to conduct, it is possible to substantially shorten the rise time of the voltage waveform applied across the upper and lower electrodes of the piezoelectric devices. This, in turn, makes it possible to increase the vibration plate deformation speed and acceleration, and thus to improve the liquid jet characteristics. Accordingly, it is possible to realize a liquid jet recording head having good liquid jet characteristics, even when using TFTs having large ON resistance in the drive circuits.

It is also permissible to drive a piezoelectric device using a voltage waveform like that indicated at 604. If that is done, only the piezoelectric device 511 is driven, but a small negative voltage is applied, preparatorily, to the lower electrode of the piezoelectric device at time t7, before the analog switch 505 begins to conduct. At time t6 the analog switch 505 is completely conductive, the upper electrode of the piezoelectric device 511 goes to a positive potential, and a small voltage is applied across the upper and lower electrodes. Then, at time t8, the lower electrode of the piezoelectric device 511 goes to a negative potential, whereupon there is no potential difference across the upper and lower electrodes. Then, at time t9, the lower electrode of the piezoelectric device 511 goes to a negative potential, a large voltage is applied across the upper and lower electrodes, and the piezoelectric device is driven. By adopting such a drive method as this, polarization processing is done by the small voltage that is applied before the piezoelectric device is driven.

Because polarization processing is continually done at a constant voltage prior to driving, degradation of such characteristics in the piezoelectric device as its voltage distortion constant will be reduced, whereupon highly reliable liquid jet recording heads can be realized.

In this embodiment, the analog switches use P-channel TFTs. The reason for this is that, in the course of the research done by the inventors, it was found that, when driving a large additional capacitance, more outstanding reliability was achieved with P-channel TFTs than with N-channel TFTs. This will be described in more specific terms below. The inventors further discovered that, when they connected a piezoelectric device to an analog switch based on a P-channel poly-Si TFT, and performed driving tests using the actual piezoelectric device drive signal waveform indicated at 603, when the relationship $C/(L \cdot W) \geqq 3.3 \times 10^{-2}$ ($F/m^2$) was satisfied, where L is the TFT channel length, W the channel width, and C the piezoelectric device capacitance, with a drive signal voltage amplitude of 20 V, the decline in the liquid jet velocity after 1 billion liquid jet repetitions per nozzle at room temperature was less than 10% of the initial jet velocity. This decline in liquid jet velocity is caused by a degradation in piezoelectric device characteristics and by an increase in TFT ON resistance. Of these, the increase in TFT ON resistance becomes larger as the capacitance C of the piezoelectric device increases, and smaller as the TFT channel length L and channel width W become greater. This is because, the greater the current density flowing through the TFT channel, and the longer the time required for the capacitance to charge, the greater is the ON resistance exhibited by the TFT. When similar drive tests were conducted using analog switches based on N-channel poly-Si TFT with the phase of the drive signal for the liquid jet recording head indicated in FIG. 11 inverted, and with the drive signal voltage amplitude similarly at 20 V, and C, L, and W used in the same way as with the P-channel TFT, the decline in liquid jet velocity was 30% of the initial velocity, whereupon it became evident that the main cause was the increased ON resistance of the N-channel TFT. Accordingly, for use in the analog switches in this embodiment, the P-channel TFT is more highly reliable than is the N-channel TFT, and it is therewith possible to make the piezoelectric device drive signal voltage amplitude—which is to say the drive voltage—larger.

(Embodiment 6)

Figure 12:
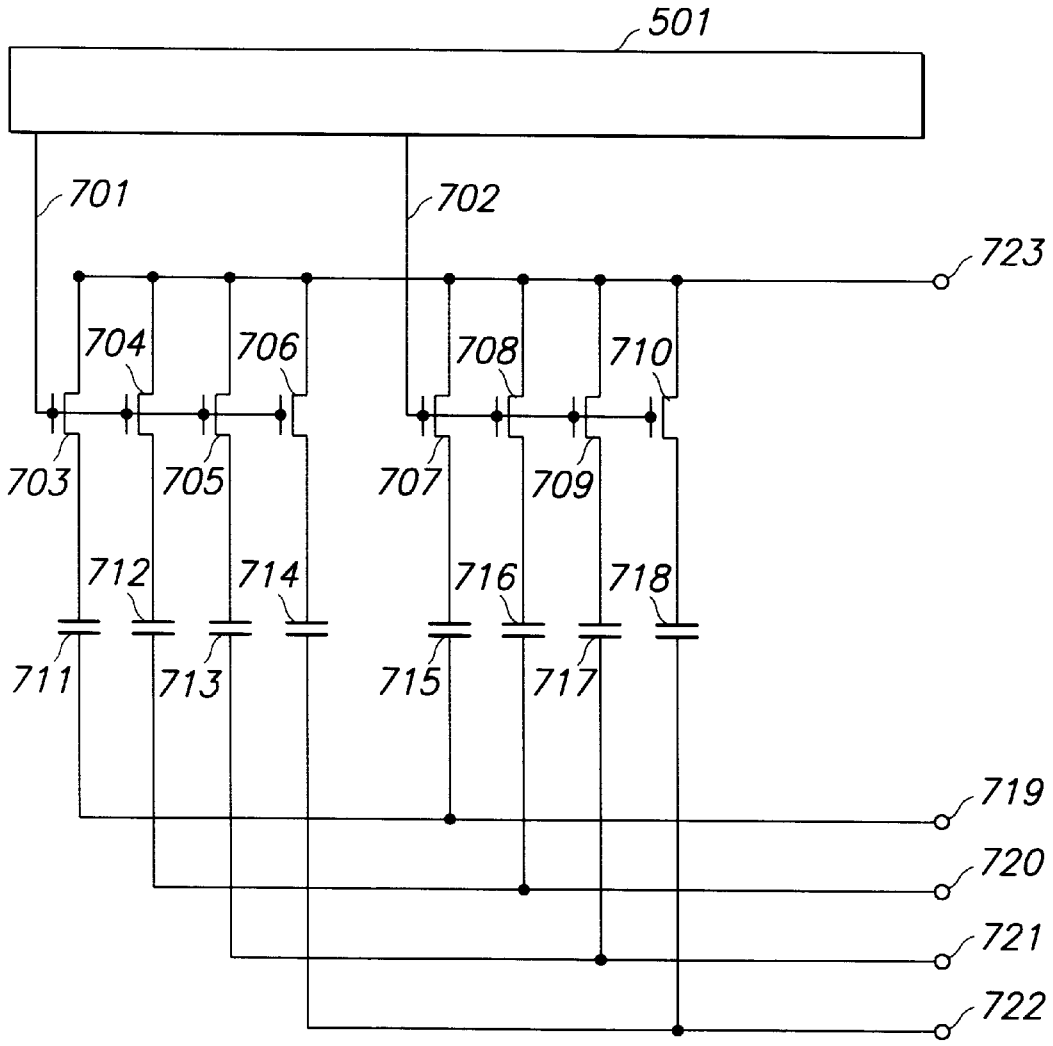
FIG. 12 is a schematic of a drive circuit in a liquid jet recording head for driving a plurality of piezoelectric devices simultaneously, in an embodiment of the present invention.

FIG. 12 is a schematic of a liquid jet recording head drive circuit that simultaneously drives a plurality of piezoelectric devices in an embodiment of the present invention. This drive circuit can also be applied to a color-capable liquid jet recording head drive circuit. In FIG. 12, item 501 is a scanning circuit having a TFT-based configuration. This scanning circuit may be configured with shift registers, but it is also permissible to provide buffer inverters, etc., in the output stage thereof. Items 701 and 702 are output signal lines for the TFT scanning circuit 501, which are connected to the gates of P-channel TFT-based analog switches 703 to 706 and 707 to 710. The output terminals of the analog switches 703 to 706 and 707 to 710 are connected to the upper electrodes of piezoelectric devices 711 to 714 and 715 to 718, respectively. The other electrodes (lower electrodes) of the piezoelectric devices 711 and 715 are connected to the piezoelectric device drive signal input terminal 719. Similarly, the lower electrodes of the piezoelectric devices 712 and 716, 713 and 717, and 714 and 718, are connected to the piezoelectric device drive signal input terminals 720, 721, and 722, respectively. The other terminals of the analog switches 703 to 710 are connected to the positive power supply input terminal 723.

If a black signal, cyan signal, yellow signal, and magenta signal are input to the piezoelectric device drive signal input terminals 719, 720, 721, and 722, respectively, a color-capable liquid jet recording head drive circuit is realized.

The benefits of the present invention are now described. By using the liquid jet recording head and manufacturing method therefor, and the liquid jet recording head drive circuit and drive method, of the present invention, as described in the foregoing, the following benefits are gained.

(1) By connecting the upper electrode on the head substrate and the output terminal of the drive circuit using the TFT on the dielectric substrate so as to face each other, providing a mounting substrate on the side of this dielectric substrate on which there is no TFT, sealing in the space enclosed by the head substrate, the edge surfaces of the dielectric substrate, and the loading substrate, and forming the liquid storage chamber, and also by making the alignment pitch of the piezoelectric devices on the head substrate and the alignment pitch of the output terminals of the drive circuit the same, it becomes possible to effect a structure that is compact in its planar extent and three-dimensionally, even in a line liquid jet recording head having 100 or more nozzles.

(2) By first connecting the upper electrode on the head substrate and the output terminal of the drive circuit using the TFT on the dielectric substrate so as to face each other, then forming the protective layer for this connection, and finally providing the mounting substrate at the surface of the dielectric substrate where there is no TFT, forming the protective layer is rendered easy, inspecting for and repairing coating irregularities on the protective layer is also made easy, and the liquid jet recording head manufacturing method becomes efficient.

(3) By providing such that the relationship $C/(L \cdot W) \geqq 3.3 \times 10^{-2}$ ($F/m^2$) is satisfied, where L is the TFT channel length, W is the channel width, and C is the piezoelectric device capacitance, and adopting P-channel TFTs in the analog switches in a liquid jet recording head drive circuit wherein TFTs are used, it was possible to raise the piezoelectric device drive voltage. Also, in the drive method for liquid jet recording heads using TFTs, by making the timing with which the piezoelectric device drive is started in the piezoelectric device drive signal later than the timing with which the analog switches begin to conduct, it was possible to substantially shorten the rise time for the drive voltage waveform applied across the upper and lower electrodes of the piezoelectric device.

What is claimed is:

1. A liquid jet recording head comprising:

a liquid chamber for holding a liquid to be jetted, the liquid chamber defining at least one nozzle from which the liquid is jetted;

a vibration plate disposed above the liquid chamber, the vibration plate defining a liquid supply hole for supplying the liquid to the liquid chamber;

a piezoelectric device disposed above the vibration plate and including a lower electrode, a piezoelectric film and an upper electrode in a laminated structure, wherein the piezoelectric device bends the vibration plate to alter the volume of the liquid chamber whereby the liquid is jetted out;

a dielectric substrate disposed adjacent the piezoelectric device;

a drive circuit for driving the piezoelectric device, the drive circuit including a thin film transistor and an output terminal disposed on a surface of the dielectric substrate, wherein the output terminal and the upper electrode of the piezoelectric device are electrically connected and overlap each other when viewed in a direction of lamination of the piezoelectric device; and a mounting and sealing structure cooperating with at least one of the vibration plate, the piezoelectric device and the dielectric substrate to define a liquid storage chamber for storing the liquid supplied to the liquid chamber.

2. The liquid jet recording head of claim 1, wherein the mounting and sealing structure comprises a mounting substrate and a sealing structure formed separately from the mounting substrate.

3. The liquid jet recording head of claim 1, wherein the recording head comprises a plurality of piezoelectric devices defining a pitch, and an alignment plurality of drive circuits defining an alignment pitch identical to that of the piezoelectric devices.

4. The liquid jet recording head of claim 1, further comprising a protective layer at the location where the upper electrode of the piezoelectric device and the output terminal of the drive circuit are connected.

5. The liquid jet recording head of claim 1, wherein the recording head comprises a plurality of liquid chambers forming a row and each having a first and a second end, a plurality of piezoelectric devices each associated with a liquid chamber and having a connecting terminal connected to the upper electrode, the piezoelectric devices being disposed so that the connecting terminals are located alternately adjacent one of the first and second ends of the associated liquid chambers, and a plurality of drive circuits alternately disposed adjacent one of the first and second ends of the liquid chambers and each connected to the connecting terminal of a piezoelectric device.

6. The liquid jet recording head of claim 5, wherein the row of the plurality of liquid chambers defines a center line of the row, wherein the upper electrode of the plurality of piezoelectric devices are disposed in a staggered pattern, wherein the connecting terminal of each upper electrode is disposed further away from the center line than is an edge of the adjacent upper electrode, and wherein the liquid supply hole of each chamber is disposed further away from the center line than is an edge of the upper electrode of the associated piezoelectric device and closer to the center line than is the connecting terminal of the adjacent piezoelectric device.

7. The liquid jet recording head of claim 1, wherein the recording head comprises a plurality of liquid chambers forming two rows, each liquid chamber having an inside end and an outside end, a plurality of piezoelectric devices each associated with a liquid chamber and having a connecting terminal connected to the upper electrode, the piezoelectric devices being disposed so that the connecting terminals are located adjacent the outside ends of the associated liquid chambers, and a plurality of drive circuits disposed adjacent the outside ends of the liquid chambers and each connected to the connecting terminal of a piezoelectric device.

8. The liquid jet recording head of claim 1, wherein the mounting and sealing structure comprises a mounting substrate provided on a surface of the dielectric substrate other than the surface on which the thin film transistor is disposed.

9. A method for manufacturing a liquid jet recording head comprising:

providing a head substrate having a liquid chamber for holding a liquid to be jetted, a vibration plate disposed above the liquid chamber, and a piezoelectric device disposed above the vibration plate and including a lower electrode, a piezoelectric film and an upper electrode in a laminated structure;

providing a drive circuit for driving the piezoelelectric device, the drive circuit having a thin film transistor and an output terminal formed on a surface of a dielectric substrate;

electrically and mechanically connecting the upper electrode of the piezoelectric device and the output terminal of the drive circuit so that they overlap each other when viewed in a direction of lamination of the piezoelectric device; and providing a protective layer at the connection of the upper electrode and the output terminal.

10. The method of claim 9, further comprising attaching a mounting substrate to a surface of the dielectric substrate other than the surface on which the drive circuit is formed.

11. The method of claim 10, further comprising sealing a space enclosed by the head substrate, the dielectric substrate and the mounting substrate.

12. An improved liquid jet recording head comprising a liquid chamber for holding a liquid to be jetted, a vibration plate disposed above the liquid chamber, a piezoelectric device disposed above the vibration plate and including a lower electrode, a piezoelectric film and an upper electrode in a laminated structure, and a dielectric substrate disposed adjacent the piezoelectric device, wherein the improvement comprises:

a drive circuit for driving the piezoelectric device, including a scanning circuit based on a thin film transistor, an analog switch including a thin film transistor controlled by the scanning circuit, an output terminal of the analog switch being connected to one of the upper and lower electrodes of the piezoelectric device, and a drive signal input terminal connected to the other of the upper and lower electrodes of the piezoelectric device, wherein the drive circuit provides a piezoelectric device drive signal at the drive signal input terminal which is later in timing than a signal provided by the scanning circuit to bring the analog switch into a conductive state.

13. The improved liquid jet recording head of claim 12, wherein the thin film transistor of the analog switch is a P-channel thin film transistor.

14. The improved liquid jet recording head of claim 13, wherein a channel length L and a channel width W of the thin film transistor and a capacitance C of the piezoelectric device satisfy the equation $$C/(L \cdot W) \geqq 3.3 \times 10^{-2} (F/m^2).$$

15. The improved liquid jet recording head of claim 12, wherein the thin film transistor of the analog switch is disposed on a surface of the dielectric substrate, and wherein the liquid jet recording head further comprises a mounting substrate provided on a surface of the dielectric substrate other than the surface on which the thin film transistor of the analog switch is disposed.

* * * * *